US007406787B2

(12) United States Patent
Smith et al.

(10) Patent No.: US 7,406,787 B2
(45) Date of Patent: Aug. 5, 2008

(54) ILLUMINATED ROAD SIGN

(76) Inventors: Stephan Trevor Smith, "Firgarth" Yester Park, Chislehurst, Kent BR7 5DG (GB); Mark Southgate Walter, 2 Pitt Road, Epsom, Surrey KT17 4ET (GB); Mike Bodeckyj, 14 Burne-Jones Drive, College Farm, Sandhurst, Berkshire GU47 0FS (GB)

( * ) Notice: Subject to any disclaimer, the term of this patent is extended or adjusted under 35 U.S.C. 154(b) by 339 days.

(21) Appl. No.: 10/483,352

(22) PCT Filed: Jul. 5, 2002

(86) PCT No.: PCT/GB02/03153

§ 371 (c)(1),
(2), (4) Date: Jul. 16, 2004

(87) PCT Pub. No.: WO03/007282

PCT Pub. Date: Jan. 23, 2003

(65) Prior Publication Data

US 2004/0244246 A1 Dec. 9, 2004

(30) Foreign Application Priority Data

Jul. 7, 2001 (GB) ..... 0116641.2
Oct. 1, 2001 (GB) ..... 0123559.7

(51) Int. Cl.
*G09F 13/22* (2006.01)

(52) U.S. Cl. ..... 40/544; 40/612; 40/553; 40/442

(58) Field of Classification Search ..... 40/544; 250/458.1, 208.4, 483.1, 552; 257/80, 81
See application file for complete search history.

(56) References Cited

U.S. PATENT DOCUMENTS 3,411,036 A * 11/1968 Casey ..... 315/149
3,641,487 A 2/1972 Rogers et al.
3,675,023 A * 7/1972 Kunke et al. ..... 250/338.1
3,735,141 A * 5/1973 Beling ..... 250/214 R
4,420,898 A * 12/1983 Moses ..... 40/570
4,466,208 A * 8/1984 Logan et al. ..... 40/544
4,857,920 A 8/1989 Kataoka et al.

(Continued)

FOREIGN PATENT DOCUMENTS

EP 0 621 576 A1 10/1994

(Continued)

OTHER PUBLICATIONS

Patents Act 1977: Search Report under Section 17 for United Kingdom Counterpart Application No. GB 0123559.7 (Mar. 19, 2002).

(Continued)

*Primary Examiner*—Lesley D. Morris
*Assistant Examiner*—Christopher E Veraa
(74) *Attorney, Agent, or Firm*—Blakely, Sokoloff, Taylor & Zafman LLP

(57) ABSTRACT

An illuminated sign (2) comprises a sign panel (5) and at least two elements of electroluminescent material (14, 15) each element being individually selectively actuable and arranged to emit light so as to illuminate the sign panel. Each element may be used as a photodetector or a photo-emitter. A retro-reflective strip (10) may provide additional visibility.

34 Claims, 12 Drawing Sheets

U.S. PATENT DOCUMENTS 5,065,067 A * 11/1991 Todd et al. ..... 310/339
5,105,179 A 4/1992 Smith
5,504,323 A * 4/1996 Heeger et al. ..... 250/214.1
5,523,555 A 6/1996 Friend et al.
5,600,157 A * 2/1997 Abiko et al. ..... 257/84
5,621,991 A * 4/1997 Gustafson ..... 40/544
5,709,045 A 1/1998 Thelen
5,747,938 A 5/1998 Beard
5,778,579 A * 7/1998 Yuen ..... 40/564
6,023,869 A * 2/2000 Durbin ..... 40/544
6,142,643 A * 11/2000 Araki et al. ..... 362/84
6,144,165 A 11/2000 Liedenbaum
6,726,398 B2 * 4/2004 Hamakawa et al. ..... 404/13

FOREIGN PATENT DOCUMENTS

EP 1 179 637 A1 2/2002
WO WO 99/40557 8/1999
WO WO 00/48166 A1 8/2000

OTHER PUBLICATIONS

International Search Report for PCT Counterpart Application No. PCT/GB02/03153 filed Jul. 5, 2002 (Search Report mailed Nov. 19, 2002).

* cited by examiner

ILLUMINATED ROAD SIGN

CROSS-REFERENCE TO RELATED APPLICATIONS

The present application is a National Phase Application of International Application No. PCT/GB02/03153, filed Jul. 5, 2002, which claims priority from Great Britain Patent Application No. 0116641.2, filed Jul. 7, 2001, and Great Britain Patent Application No. 0123559.7, filed Oct. 1, 2001. The present application claims priority from all three applications.

FIELD

The present invention relates to illuminated road signs, and in particular, although not exclusively, to road signs which are illuminated only at night.

BACKGROUND

Road signs are used to inform drivers of road conditions and regulations as they relate to the area in which the sign is located. Many such signs are currently made using a "retro-reflective" material, that is, a material which reflects light directly back in the direction from which it came. This property greatly increases the visibility of such signs at night by allowing light from the headlights of passing vehicles to be reflected straight back towards the driver. However, such signs can only be seen at night when they fall within the beam of a vehicle's headlights.

Earlier awareness of the road conditions and regulations gives a driver additional time to respond to such information, reducing the likelihood of accidents. It is therefore sometimes desirable to provide illuminated signs which can be seen at night even when they are not illuminated by headlights. Generally, such illumination is achieved by lamps arranged above or below the sign and directed onto the sign from in front. An alternative is to illuminate the information face of the sign from behind by using a semi-transparent face with a light arranged therebehind, shining through the face. Such signs are familiar for example from traffic bollards at junctions, which have a "light box" containing a light source, light being emitted through four faces. Such backlit signs generally have no retro-reflective properties and therefore rely fully on the backlighting for visibility.

Furthermore, signs illuminated by lamps, whether from in front or from behind, require a significant power input, which is expensive. Furthermore, in remote regions, it may be that there is no nearby source of mains electricity. Such signs are also costly to maintain and install.

One method of reducing the power required for such signs is disclosed in WO00/48166. A sign panel is illuminated from behind by a flat panel of electroluminescent material. The front of the sign comprises a retro-reflective lens.

The sign also includes a photodetector for measuring ambient light, and the electroluminescent material is only activated so as to emit light when the ambient light falls below a predetermined level—i.e. during the night.

This system works well, since electroluminescent materials require a much lower power input than conventional lamps to produce light of sufficient brightness. Since the sign is only on during the night, the long term power consumption is greatly reduced.

However, the addition of photodetectors increases the complexity of the signs. Since road signs have to be produced in large numbers, complex components are undesirable.

Furthermore, electroluminescent materials have a finite lifetime. For example, a typical material may initially generate light at 34.6 cd $m^{-2}$ when supplied with alternating current at 100V and 400 Hz. After 3,500 hours of continuous use, the light emitted under these conditions will have fallen to 30% of its initial brightness. One way to increase the lifetime of an electroluminescent light source is to decrease the voltage and frequency of the electricity supplied: for example, the material described above, if supplied at 100V ac and 60 Hz reduces to 30% brightness after 20,000 hours. However, the initial brightness is also reduced so the increased lifetime comes at a cost.

There is therefore a need for a sign which combines the added visibility of an actively illuminated sign with the safety of a retro-reflective sign. There is a further need for illuminated signs with a low power requirement. There is a yet further need for such signs which can be simply manufactured. There is a yet further need for signs with an increased working lifetime.

In accordance with a first aspect of the present invention there is provided an illuminated sign comprising:

a sign panel; and at least two elements of electroluminescent material, each element being arranged so that it can emit light so as to illuminate the sign panel, each element being selectively actuatable independently of the or each other element.

This arrangement allows the possibility that the elements can be used one at a time to illuminate the sign panel, for example two elements could be used on alternate nights. Since each element is being used less than would be the case if there was only a single element, they degrade less quickly and the lifetime of the sign is greatly increased.

Electroluminescent material is cheap to manufacture and install, and furthermore requires a much lower power input than conventional lamps. Electroluminescent materials can be formed into films, enabling the light source to be arranged as a thin film directly behind the sign panel. The use of electroluminescent film as the light source allows the source to be designed in such a way that only part of the area of the sign emits light.

Electroluminescent material also has the property that its capacitance varies with the amount of light falling on the material. By measuring the capacitance of one of the elements, it can be used as a photodetector to measure the brightness of external light falling on the sign.

Preferably, therefore, each element can be used either as a photodetector to measure the amount of external light falling on the sign, or as a photo-emitter to emit light to illuminate the sign panel. This removes the need for separate photodetectors, thereby reducing the number of complex components in the system.

One method for measuring the capacitance of an element involves the application of a constant voltage to that element. However, in order to activate an element to cause it to emit light, an alternating voltage must be applied. It is therefore not practical to use an element as a photo-emitter and photodetector at the same time.

Accordingly, when one element acts as a photo-emitter, the or each other element preferably acts as a photodetector.

Preferably the sign is arranged so that none of the elements emits light when the brightness of external light falling on the sign is above a predetermined level. This level is preferably defined such that none of the elements emits light during the day. Thus the sign will only be illuminated during the night.

Preferably, each element comprises segments interlocking with corresponding segments in the or each other element so that the segments form a spatially alternating array. This ensures that the whole sign panel will be illuminated when only one of the elements emits light.

As discussed above, the brightness of light emitted by electroluminescent material will reduce with the use of that material. The brightness of emitted light is also affected in the short term by the temperature of the material, which can vary significantly even through 24 hours. In order to compensate for this, the sign may also comprise a control system for regulating the power supplied to the elements. This system is preferably arranged to ensure that the brightness of light emitted by an element remains substantially constant over time, both through one 24 hour cycle and for the lifetime of the sign.

In order to compensate for changes within a 24 hour cycle, the control system may include power measurement means for measuring the power drawn by an element when it is acting as a photo-emitter, and a feedback loop to determine the temperature based on the power drawn by the element. Alternatively an independent temperature measurement means may be employed.

In the long term, the power supplied to each element may be regulated to compensate for degradation so that the brightness of light emitted by the elements remains substantially constant over the lifetime of the sign.

The control system may also determine whether or not each element switches between use as a photodetector and photo-emitter on a regular basis (for example once per day). If not, it is likely that the sign has developed a fault. If this is the case, all the elements are switched so that none of them emits any light. It will then be obvious in a routine check that the sign is faulty, and the fault can be rectified by replacing the control electronics.

Another way to increase the overall lifetime of the sign is to separate the light source into an array of elements or pixels activatable independently of each other. Then, for example, every other pixel is activated initially. The remaining pixels can be kept as emergency backup in case there is a failure with the primary pixels, or to use after the primary pixels have outlived their useful life.

In accordance with a second aspect of the present invention there is provided an illuminated sign, comprising a sign panel and two arrays of light sources arranged to illuminate said sign panel, each array being selectively activatable independently of the or each other array, the light sources of each array being spatially alternated.

One array may be arranged to be activated if the other array fails. Alternatively or in addition, one array may be arranged to be activated after the end of the useful life of the other array.

The sign is preferably arranged so that the arrays are only activatable when external light falling on the sign falls below a predefined level, so that the sign is not illuminated during the day.

The sign may be arranged so that the arrays are selectively activated in sequence. In other words, one of the arrays may be activated one night, and the other array the following night. Alternatively, the arrays may be selectively activated in a random sequence.

Of course, it will be appreciated that there may be more than two arrays of light sources. Three or more arrays may also be employed, operating in sequence, or in a random sequence, or with two arrays alternating and one kept in reserve.

Preferably the arrays of light sources comprise an electroluminescent material, which may be usable to detect the level of external light falling on the sign.

The illuminated sign preferably further comprises a retro-reflective portion. This may be arranged behind the sign panel, although it may form part of the sign panel itself. It will be understood that it is not necessary for the whole of the illuminated sign to be retro-reflective.

The sign preferably comprises detection apparatus for detecting the approach of a vehicle, the sign being arranged so that the light source is activated only if a vehicle is approaching. This can reduce the power consumption even further, so that the sign is only illuminated at night and only when a vehicle is approaching. The apparatus for detecting the approach of a vehicle may take any suitable form, including detecting sound or vibration in the road caused by approaching vehicles, In accordance with an embodiment of the present invention there is provided an illuminated sign assembly, comprising an illuminated sign as described above and a power source. This enables the illumination of the sign at places where mains electricity is not available.

The power source may be a rechargeable battery, and the sign assembly preferably comprises recharging means for recharging the rechargeable battery. The recharging means may comprise a photovoltaic cell, and/or a device for generating electricity using vibration from passing vehicles.

In accordance with a third aspect of the present invention there is provided a method of illuminating a road sign comprising a sign panel and first and second electroluminescent light sources, the method comprising:

measuring the capacitance of the first light source;

determining the level of external light falling on the sign from the measured capacitance; and illuminating the sign panel with the second light source if the external light falls below a predefined level.

BRIEF DESCRIPTION OF THE DRAWINGS

Some preferred embodiments of the invention will now be described by way of example only and with reference to the accompanying drawings, in which.

DETAILED DESCRIPTION

Figure 1:
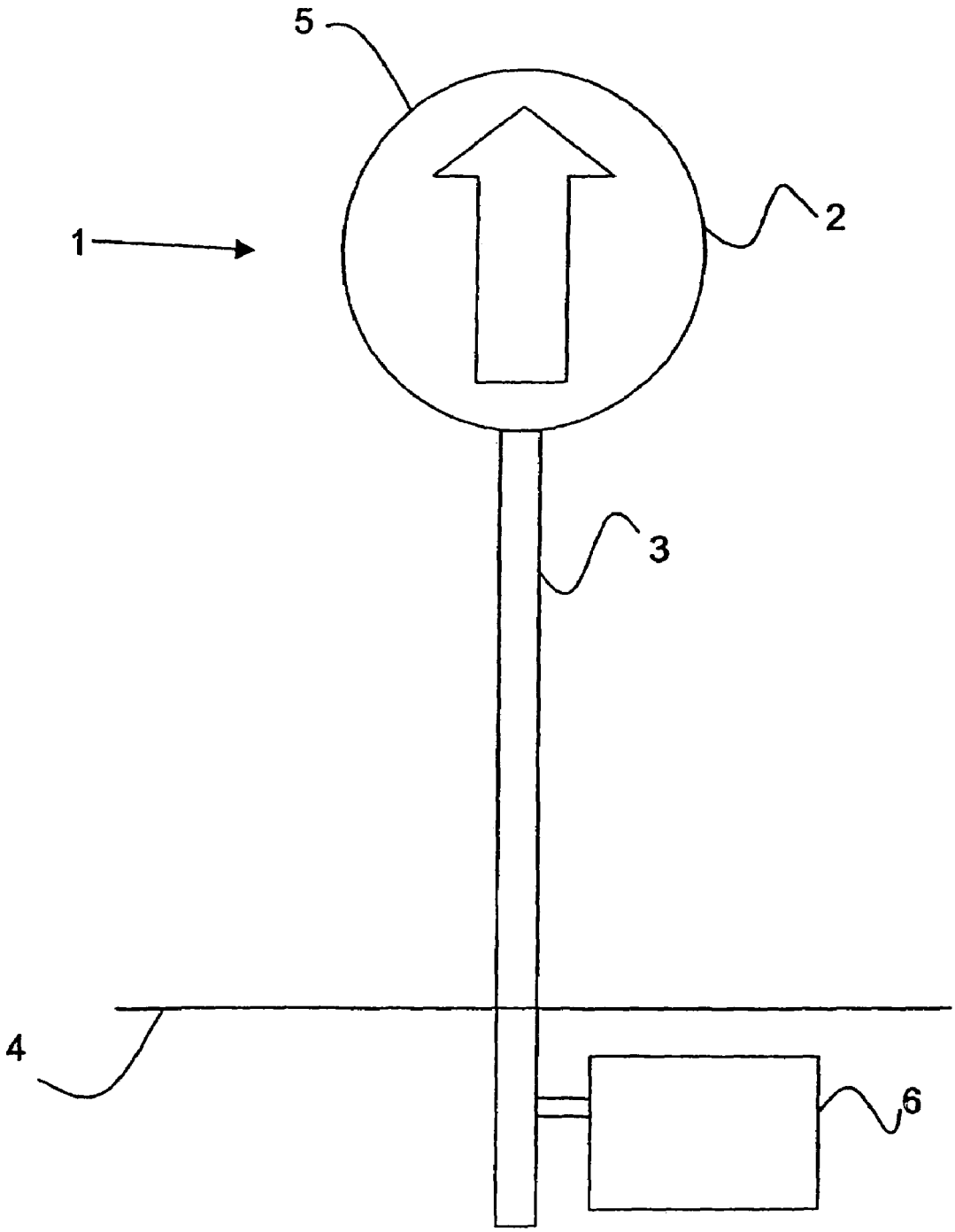
FIG. 1 shows a view of an illuminated sign assembly in accordance with the present invention.

FIG. 1 shows a sign assembly 1 comprising a sign 2 mounted in the ground 3 via a hollow post 4, preferably made from galvanised steel. The sign has a sign panel 5 facing towards oncoming traffic. The panel is illuminated by an electroluminescent film (ELF) (not shown) mounted behind the panel. The ELF may be formed of conventional electroluminescent material or organo-electroluminescent material.

Although the sign can be connected to mains electricity, the sign assembly of the embodiment shown comprises a power supply 6 mounted in the ground. The power supply 6 includes a rechargeable battery and an electronic control system for controlling when the ELF is switched on so as to illuminate the sign panel. The power supply 6 is operably connected to the ELF via leads (not shown) running through the middle of the metal post 4. A sign of 270 mm diameter requires power at about 100 V (ac) at about 400 to about 700 Hz to provide 65 cd, which is the minimum for road signs.

Mounted around the post 4 are photovoltaic cells (not shown) which supply power during the day to the rechargeable battery, enabling the battery to be recharged during the day so as to supply power to the ELF during the night. Alternatively, a device for generating electricity from ambient vibration may be used to recharge the battery.

Figure 2:
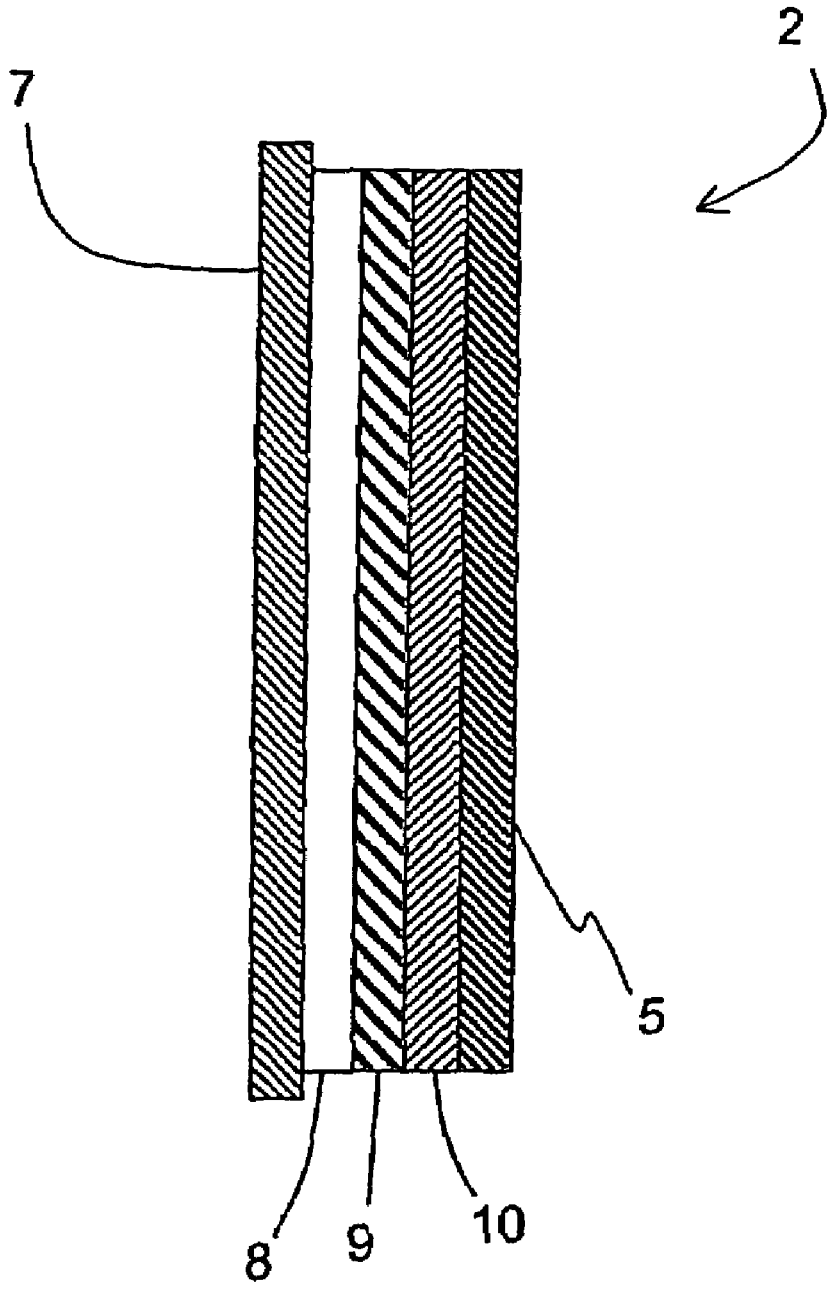
FIG. 2 shows a cross section of part of the sign assembly of FIG. 1.

FIG. 2 is a cross section of the sign 2. The sign 2 consists of an aluminium or plastic back plate 7, onto which is laminated a white layer 8, an electroluminescent film (ELF) 9, and a retro-reflective layer 10 consisting of a transparent or translucent retro-reflective material. The sign panel 3 is arranged as a transparent coloured overlay on the retro-reflective layer 10. Additional information can be provided by the provision of more overlays or more retro-reflective elements (not shown) attached to the front of the sign 2.

It will be appreciated that not all of the sign need necessarily be retro-reflective or illuminated: for example, in the sign shown in FIG. 1 it could be that only the arrow 11 is illuminated and/or retro-reflective. It will be understood that the retro-reflective layer 10 is only retro-reflective for light approaching within a few degrees of normal to the layer 10. In other words, some of the ambient light from the sky, striking the retro-reflective layer obliquely, will not be reflected by the layer but will penetrate through to the ELF 9.

Figure 3:
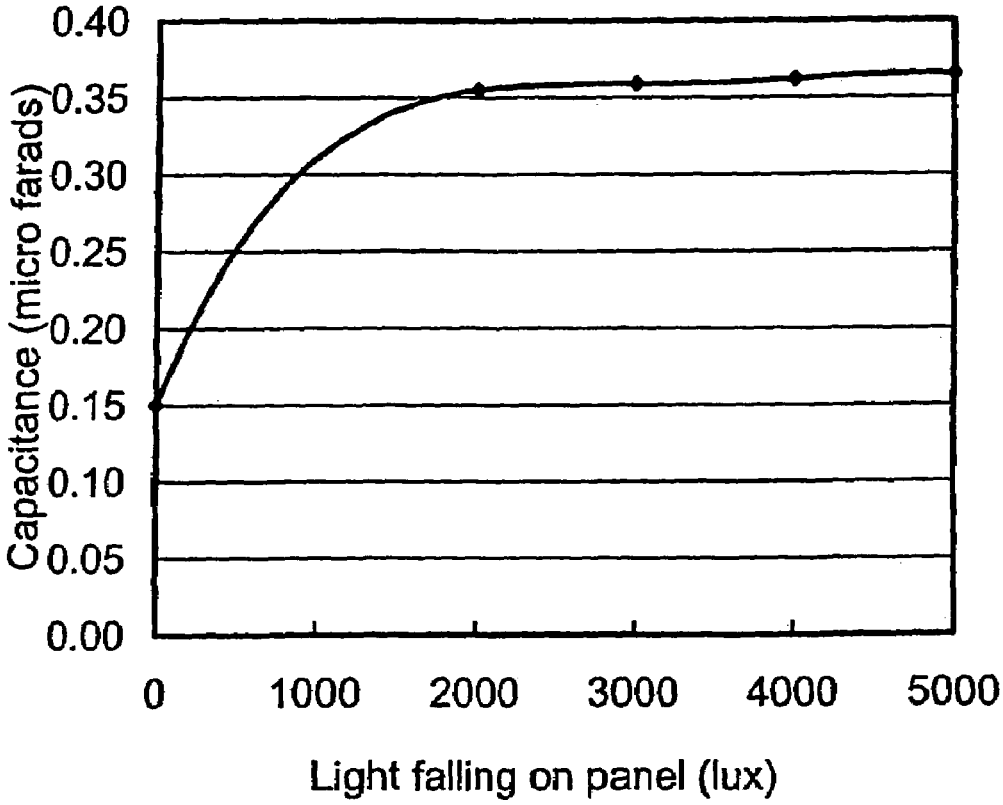
FIG. 3 shows the variation of capacitance of an electroluminescent material with light falling on the material.

It is a little known property of many electroluminescent materials that the capacitance of such a material changes when the material is exposed to light. In a test sample of ELF of area 500 $cm^2$, the amount of light falling upon the face of the sample was varied and the capacitance of the material was measured. It was found that even relatively low levels of light falling upon the face of the sample resulted in a significant change in the capacitance of the material, as shown in FIG. 3. This increase in capacitance results in a reduction in the amount of light emitted from the material.

The data indicates that there is a relatively rapid increase in capacitance as the light levels falling on the face of the ELF increase from 0 lux (total darkness) to around 1,500-2,000 lux (the light levels in a well lit office). The capacitance then remains stable through 15,000 lux (an overcast day) and up to 150,000 (full sunlight).

This property allows the ELF to be used as a photodetector, relying on sunlight or reflected light from the surroundings to determine whether or not the illumination of the sign should be activated. During the day, the ambient light levels are sufficient to allow the sign 2 to be easily read by a motorist without any illumination. As the light falling on the sign drops to levels where such "passive readability" is no longer possible, the accompanying drop in capacitance is detected by an electronic control system, preferably located in the power supply 6. This then activates the ELF material so that the sign panel 5 is illuminated by the ELF 9. The motorist then does not need to rely on light provided by his headlights, or on ambient light such as daylight, to read the sign. However, the provision of the retro-reflective layer improves the visibility of the sign due to the fact that light from motorists' headlights will be reflected back towards them, in addition to the light from the ELF.

Figure 4:
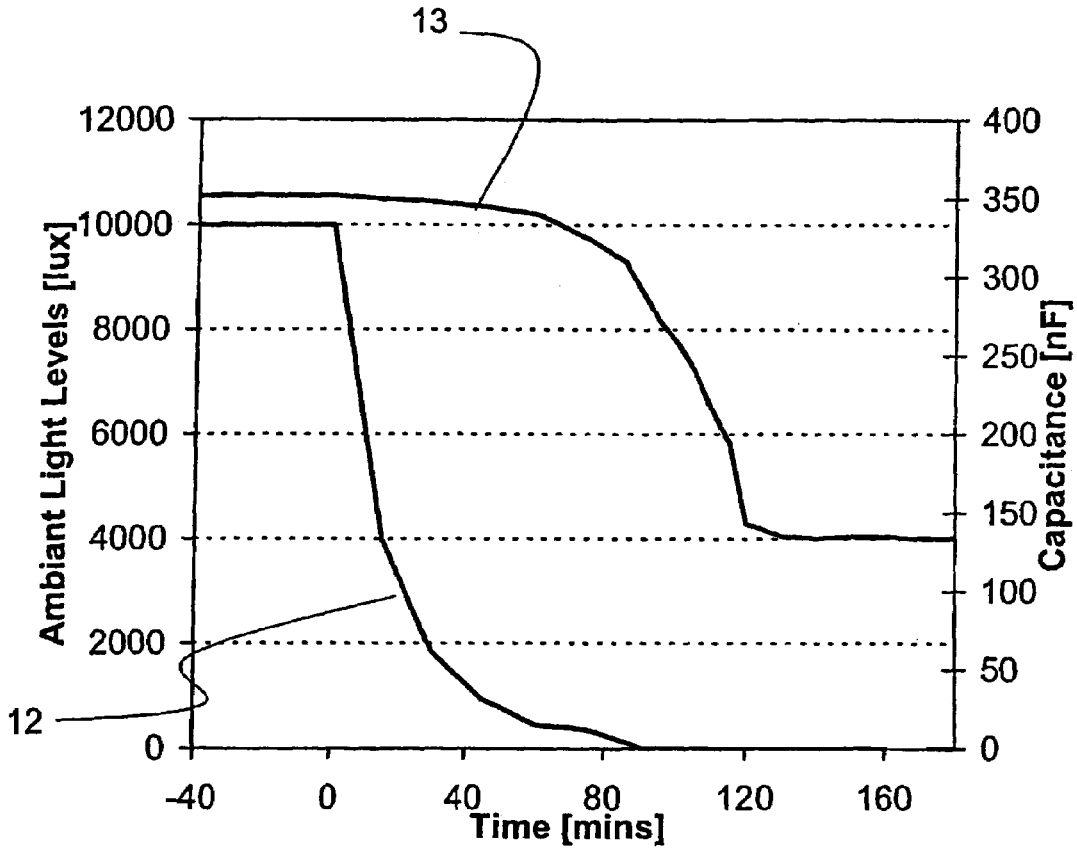
FIG. 4 shows the change in ambient light and the capacitance of an EL material through 220 minutes of a simulated sunset.

FIG. 4 is a graph showing the ambient light levels 12 through 220 minutes of a simulated sunset, together with the capacitance 13 of a typical ELF through the same period. It will be noted that there is a sharp "step" in capacitance which occurs as the ambient light levels change from day to night. This large difference means that a switching system based on the capacitance can be made relatively insensitive to system and environmental variance.

Since the capacitance shows such a sharp change between ambient light levels requiring "active readability"—i.e. light levels requiring the ELF to be activated—and light levels allowing "passive readability"—i.e. light levels in which the sign can easily be read by a motorist using ambient light—there need be no complicated orientation when a sign is installed. The effect is sufficiently large that there is a large margin for error.

In addition, the effect is still present when the ELF is placed behind filters designed to cut out light at ultraviolet wavelengths. Therefore a UV protection layer (not shown) can be included in the construction of the sign 2. The UV protection layer is important for prolonging the life of the ELF 9.

Figure 5:
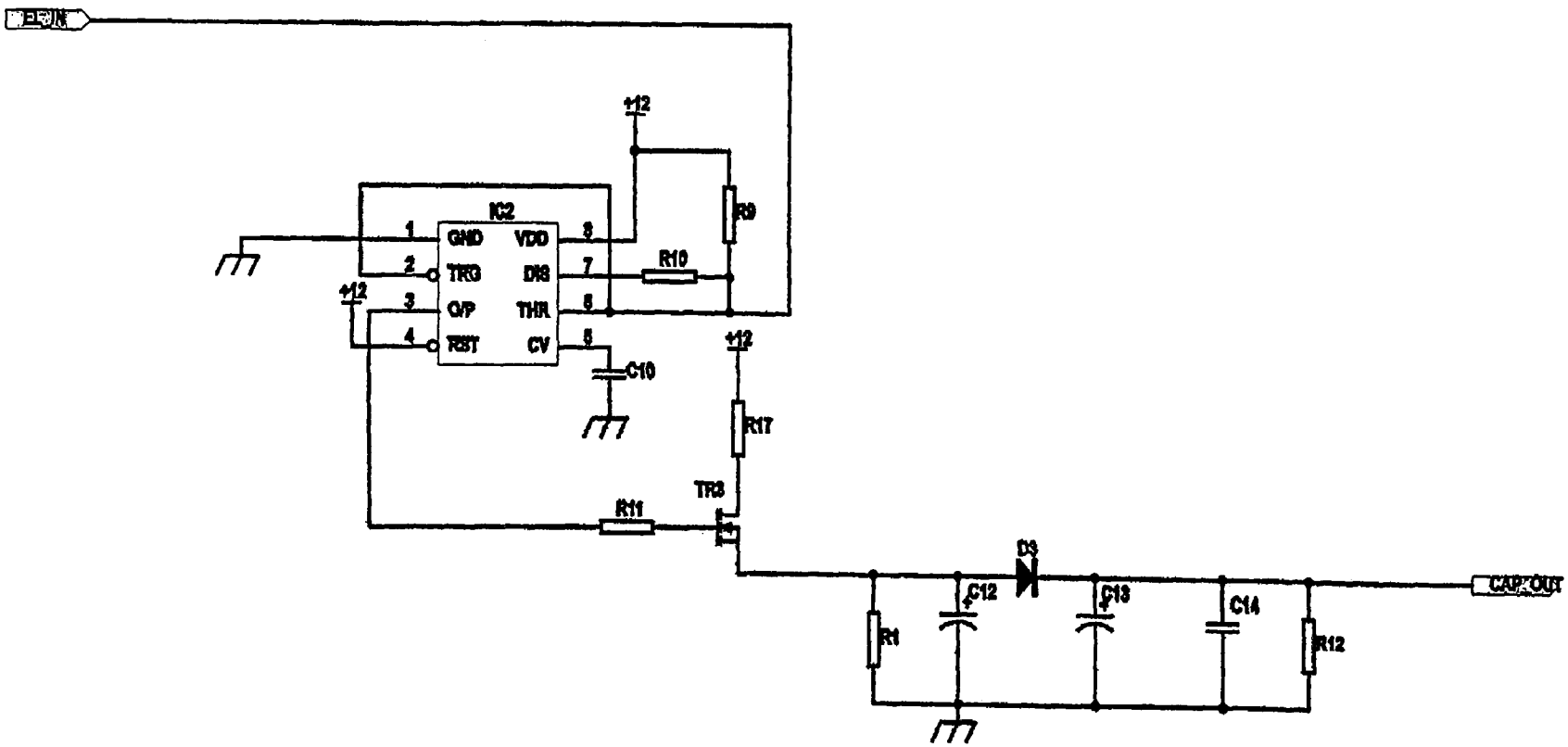
FIG. 5 is a circuit diagram for a capacitance switch.

FIG. 5 shows a circuit capable of monitoring the change in capacitance in an EL material and converting it into a signal which can be used to switch the sign on or off in response to changing light levels. The simplest form of the circuit uses an EL element that is off. The circuit converts the capacitance to a voltage. A threshold voltage is set to correspond to the light levels at which the sign should be switched on or off.

The simplest method of utilizing the "capacitance switching effect" is to monitor the capacitance of an EL material in its inactive state (off). In this state, a direct current can be used to simply ascertain the capacitance. When the capacitance falls below a certain level the EL material should be activated to cause it to emit light.

However, the EL material in an "active" (light emitting state) is powered by an alternating (ac) voltage. Whilst the capacitance effect is still present, it is significantly more difficult to convert it into a usable, measurable signal. It is therefore impractical to use this effect as an ambient light detector when the EL material is being used as a light emitter. In other words a single EL element cannot use the capacitance effect to determine when the ambient light rises above the predefined level (i.e. in the morning), and switch itself back to an inactive state.

It is therefore necessary to create an element within the sign that can be used as a light-sensing device by remaining inactive whilst the rest of the EL material is active. This can be done by using a separate piece of EL material for use exclusively as a light detector, but a more preferred alternative is to use two EL elements, each of which can be used as either photodetectors or photo-emitters.

Figure 6:
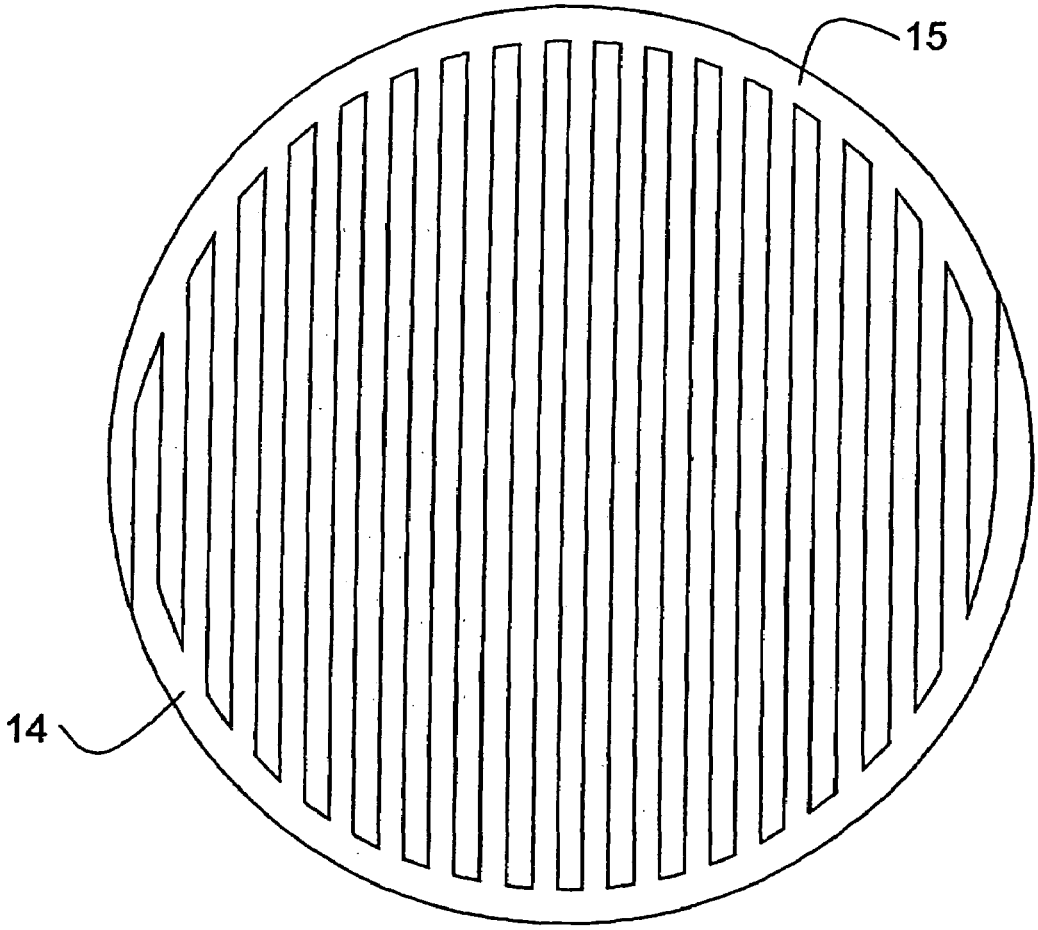
FIG. 6 is a schematic view of two EL elements arranged in segments to provide a spatially alternating array.

A suitable arrangement is shown in FIG. 6, in which the ELF 9 comprises first and second individually addressable EL elements 14, 15. The elements include interlocking "segments" so that the effect is of a spatially alternating array across the surface of the sign. If only one of the elements 14, 15 is activated, the whole face of the sign will still be illuminated.

In use, the first element 14 is activated at night, while the second element 15 remains in the "off" state but is used as a photodetector using the "capacitance effect" to monitor the level of external light falling on the sign. When the external light level rises above the predefined level (i.e. in the morning), this is detected by the second element 15, and the first element 14 is switched off. Now either or both of the elements can act as photodetectors. The following evening, when the ambient light falls below the predefined level, the second element 15 is switched on to emit light. The first element 14 remains in the "off" state so that it can be used as a photodetector. The following night the roles of the two elements are again reversed.

Thus each element only acts as a photo-emitter every other night. Since each emitter is only used for half of the time, it will be readily seen that the lifetime of each emitter (and thus the sign as a whole) is doubled. Furthermore, since each photo-emitter also acts as a photodetector, the need for further photodetectors is avoided, simplifying construction of the sign.

It will be appreciated that there could be more than two elements in the sign. For example, if there are three elements, each element need only be activated to emit light one night in three. The provision of more than two elements also allows give additional protection against complete unit failure, since if one out of three elements fails, the other two could continue to be used on alternate nights. It will further be appreciated that any suitable form of interlocking segments, or even addressable pixels, may be used so as to give coverage across the sign.

In one embodiment the output of more than one EL element used as a photodetector can be electronically combined, and the averaged result used to give a more accurate prediction of light levels. This would have advantages in areas where light levels varied over the surface of the sign.

The use of this "photo-capacitance" effect significantly extends the effective life of the ELF 9 as it allows it to be switched on only when it is required (in low light) without the need for additional structures or sensors.

It is possible to further increase the lifetime of the EL elements by the use of an additional sensor (not shown) arranged to detect approaching vehicles. Then the elements 14, 15 can be activated only at night when a vehicle is approaching. Such sensors are well known, and could include vibration, sound or light sensors either located at the sign or some distance down the road.

Figure 7:
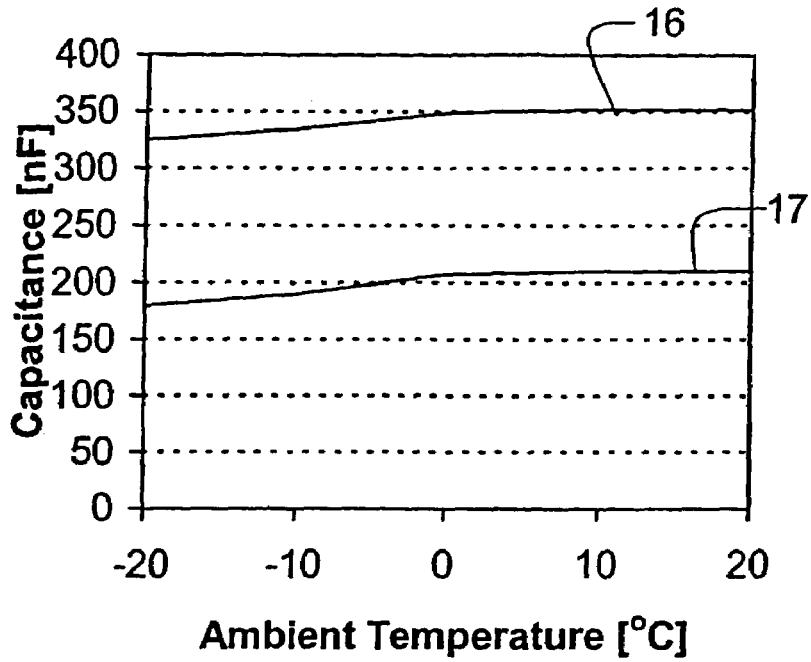
FIG. 7 is a graph showing the change in capacitance of an EL material with temperature at two illuminations.

It will be appreciated that as the ambient temperature varies, the properties of the EL material change. This can affect the point at which the "Capacitance Switch" operates. However, the large "step" in capacitance that occurs as ambient light levels change from those providing unassisted viewing of the sign, and those needing sign illumination makes the capacitance switching relatively insensitive to temperature change. FIG. 7 is a graph showing how the capacitance of a typical EL material changes with temperature at light levels corresponding to night-time. It can be seen from this that the change in capacitance caused by temperature change is small compared to the change in capacitance caused by the change in ambient light levels.

Experimentation has shown that variations in environmental temperatures can have further significant effects on the EL materials to be used in the sign. These include changes in brightness of the light emitted by the ELF. In particular it will be appreciated that the ambient temperature may vary during the course of any given day.

Figure 8:
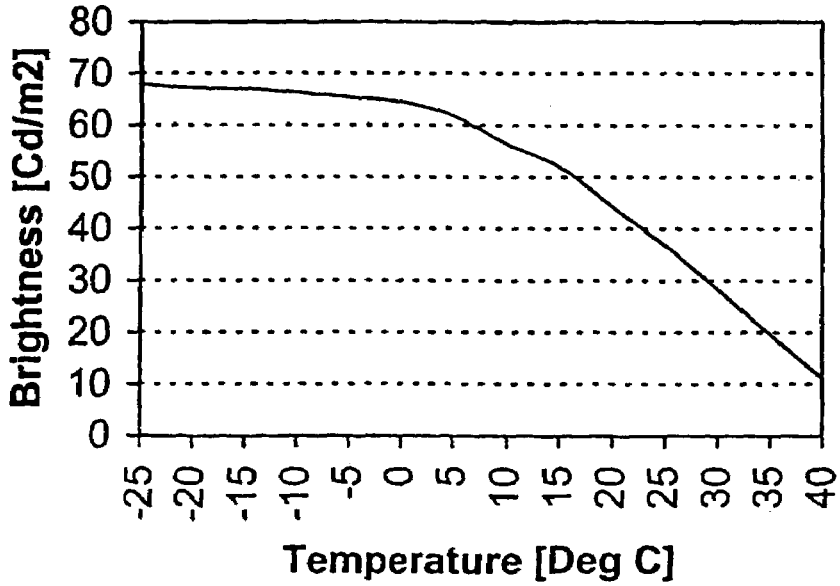
FIG. 8 is a graph showing how the brightness of light emitted by an EL element varies with the temperature of that element.

The range of operating temperature (night time) for the signs is expected to be between −10° C. in winter and 18° C. in the summer (based on Met office data for the UK). Tests have shown that over this range there is a variation in the brightness of the EL material under a specified set of input conditions (frequency and voltage). FIG. 8 is a graph showing the variation of the brightness of light emitted by an EL element with the temperature of that element.

The amount of variation is dependant on the type of phosphor used in the EL material and the way in which the EL element is constructed. A typical EL material shows an increase of brightness of approximately 30% as the temperature drops over the expected operating temperature range.

A constant level of brightness is required from a road sign; therefore, a mechanism is included into the controlling electronics to maintain the brightness as the temperature varies during the course of the night. This can be done in a number of ways.

If the brightness change with temperature is directly linked to the power consumption, i.e. lower temperature resulting in higher brightness at a given set of inputs requiring more power, it is possible to design a circuit that monitors the power being drawn by the EL element. This can then be used to adjust the inputs to maintain constant power consumption and therefore constant brightness.

A thermal resistor can be included into the electronics to produce a voltage "signal" that varies with temperature. This signal can then be fed into a micro-controller that adjusts the inputs (voltage and/or frequency) for the EL element to adjust the brightness. The micro-controller adjusts the inputs based on a model of the way in which the EL material used in the new road sign responds to temperature.

The model contains "real" data for the selected material reflecting the affect of ageing on the temperature response. It also allows the brightness to be corrected for temperature if the change is not directly linked to power consumption (if there is a change in efficiency in the system with change in temperature.

If the brightness change with temperature is directly linked to the power consumption, i.e. lower temperature resulting in higher brightness at a given set of inputs requiring more power, it is possible to design a circuit that monitors the power being drawn by the EL element. This can then be used to adjust the inputs to maintain constant power consumption and therefore constant brightness.

In addition to the short term (dynamic) temperature effects, the EL material used as a light emitter is subject to degradation due to electrical effects and environmental effects. Both these effects reduce the light output from the EL material with time under a specific set of inputs (voltage and frequency).

The process of electrical degradation takes place in phosphor materials as they are used. The higher the initial brightness of the element, the greater the rate of electrical degradation. Typically, an EL material will lose half its brightness within a few hundred hours.

For a road sign, the brightness levels required are relatively low at between 10-15 cd $m^{-2}$ (statutory requirements for street signs). However, this brightness level must be maintained over the lifetime of the sign, for example 10 years (88,000 hours). If the sign is illuminated for 12 hours per day on average, the brightness must be maintained constant over 44,000 hours.

Figure 9:
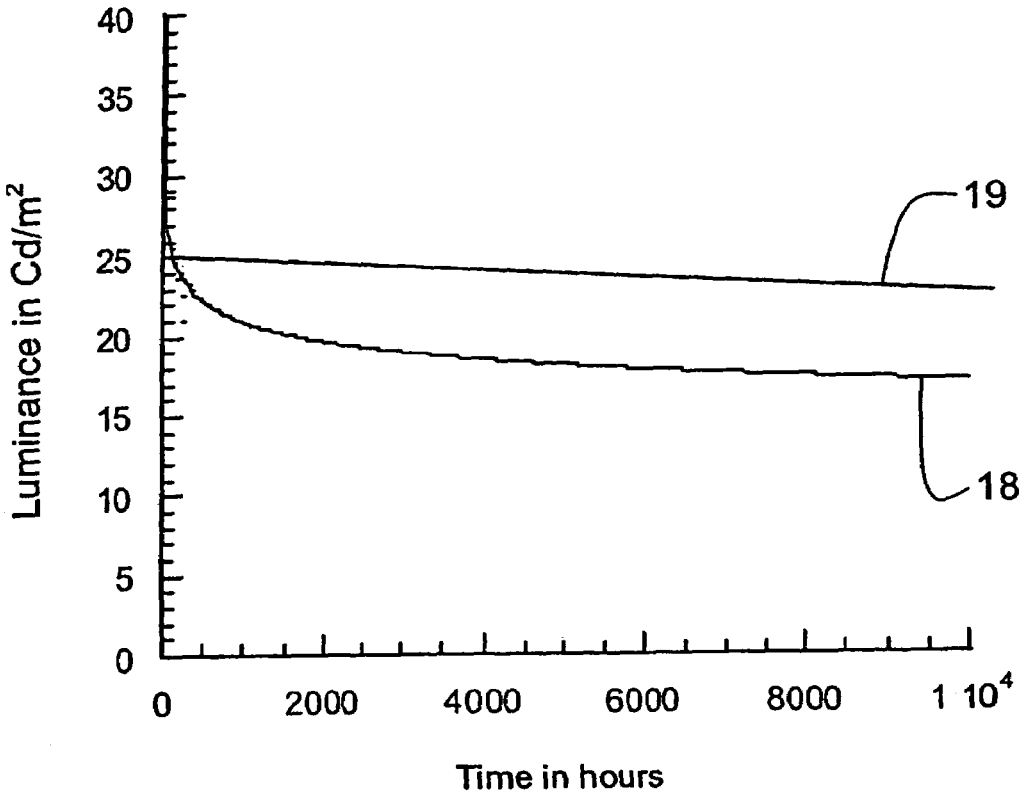
FIG. 9 is a graph showing how the brightness emitted by an EL element changes over time as a result of electrical degradation.

It is possible to predict the rate of electrical degradation, as it tends to follow a power law curve. This is shown in FIG. 9, in which the brightness of light emitted by an EL material powered continuously at 110 V and 500 Hz is shown as the line 18. The initial brightness is 40 cd $m^{-2}$, but it rapidly reduces to less than half of this value. It will be noted that there is no catastrophic failure in the material; the brightness continues to diminish over time.

One method of correcting for this is simply to allow for the fact that the brightness will decrease, and provide sufficient power so that for the first few hundred hours of use the sign will be much brighter than necessary. However, this may result in light pollution due to the excessive light emitted by the sign.

The generation of light using EL material is a relatively efficient process with most of the energy supplied to the system being converted to visible light (with some losses within the electronics). It is therefore possible to directly link the brightness to the power usage. If the electrical degradation is modelled, the power supplied to the element can be regulated so that the output brightness is almost constant, as shown by the line 19 in FIG. 9. It will be appreciated that this means that the power requirements of the element will gradually increase over time.

Other forms of degradation that can occur in EL materials are caused by humidity, temperature and ultraviolet light. Various strategies may be employed to minimise the effects of humidity and ultraviolet light over the lifetime of the new road sign. For example, the edge of the sign should be mechanically sealed. Furthermore, protective coatings and materials that are UV resistant or UV shielding may be employed.

Figure 10:
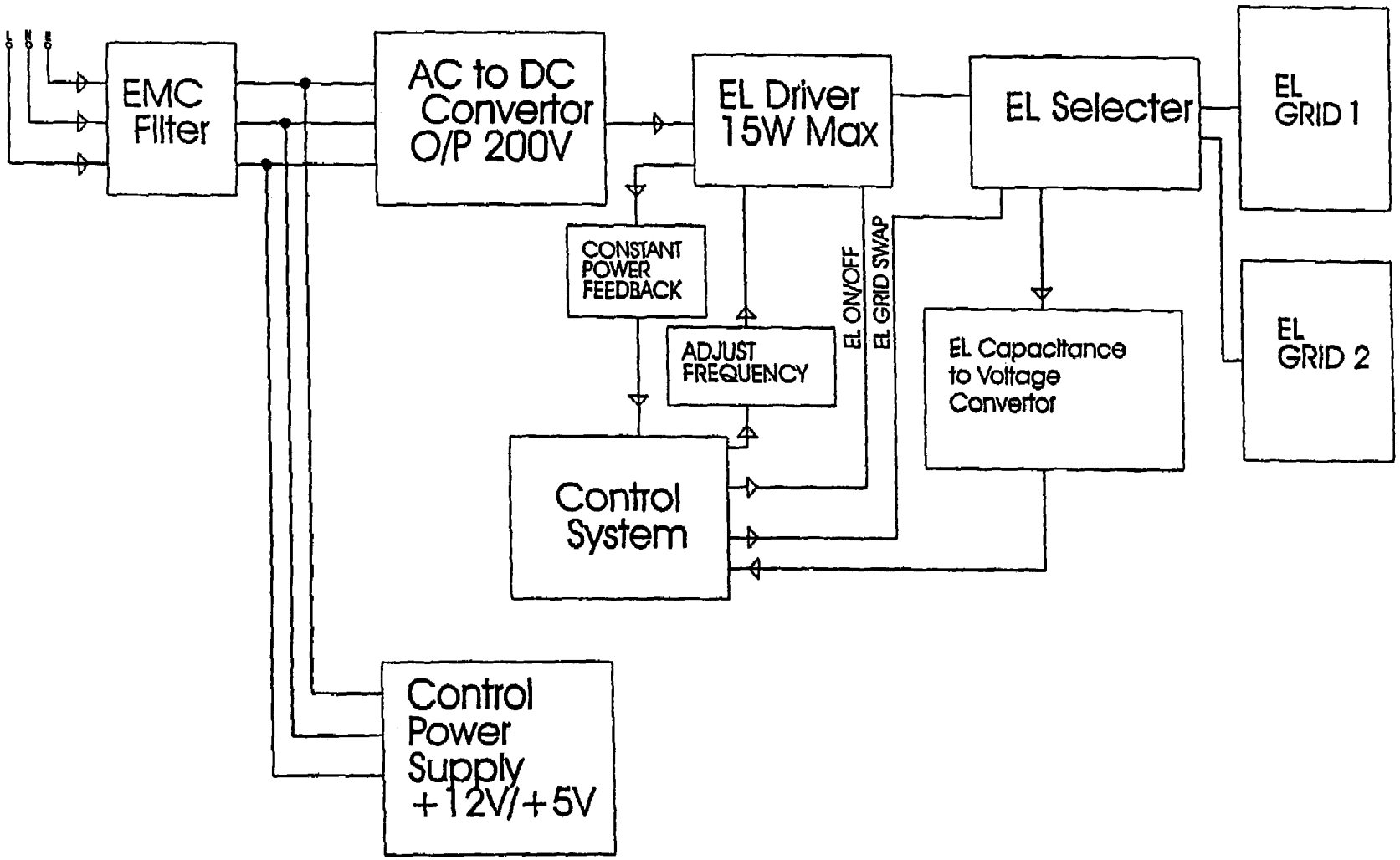
FIG. 10 is a block diagram showing the control electronics of one embodiment of a sign in accordance with the present invention.
Figure 11:
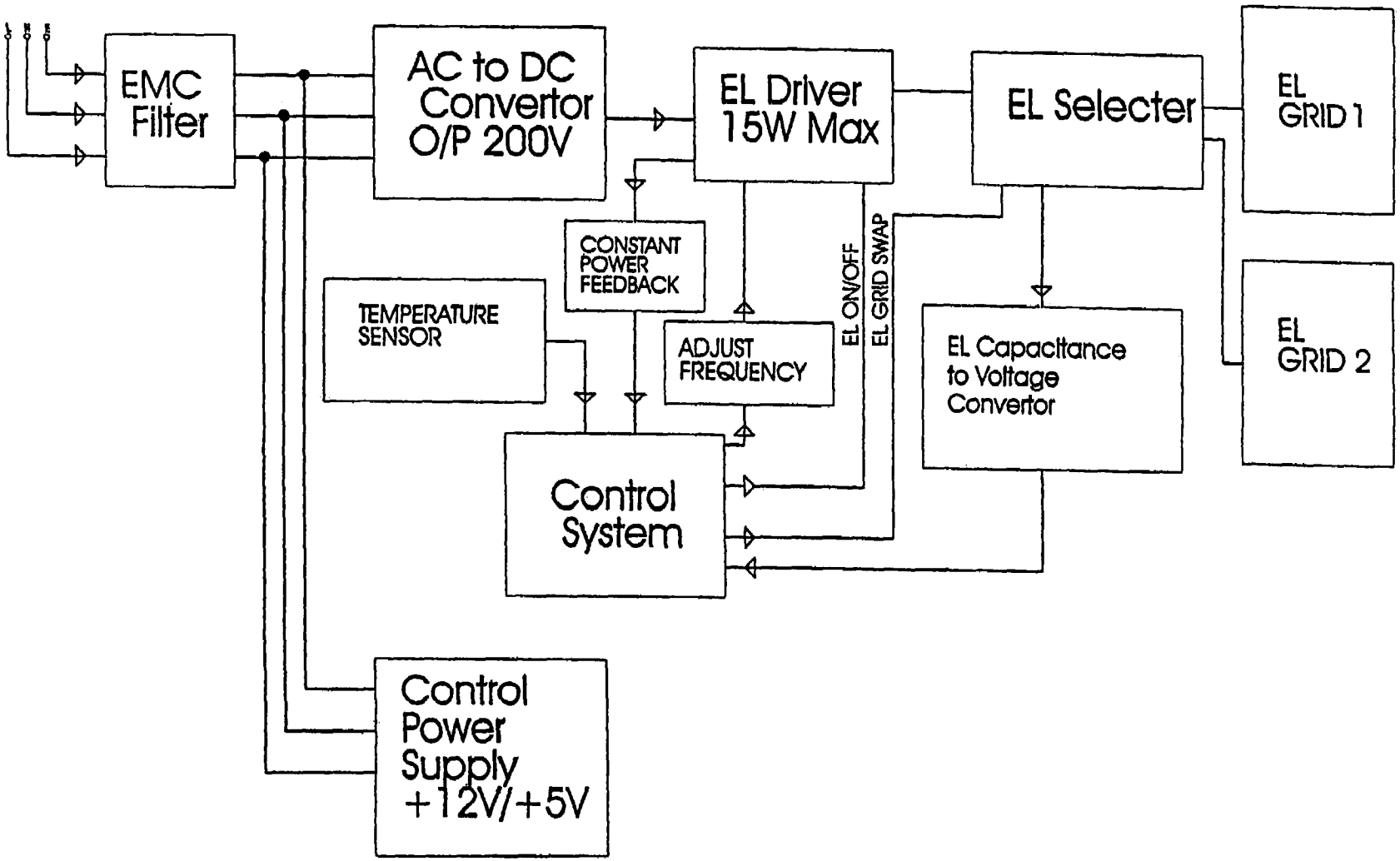
FIG. 11 is a block diagram showing the control electronics of another embodiment of a sign in accordance with the present invention.
Figure 12:
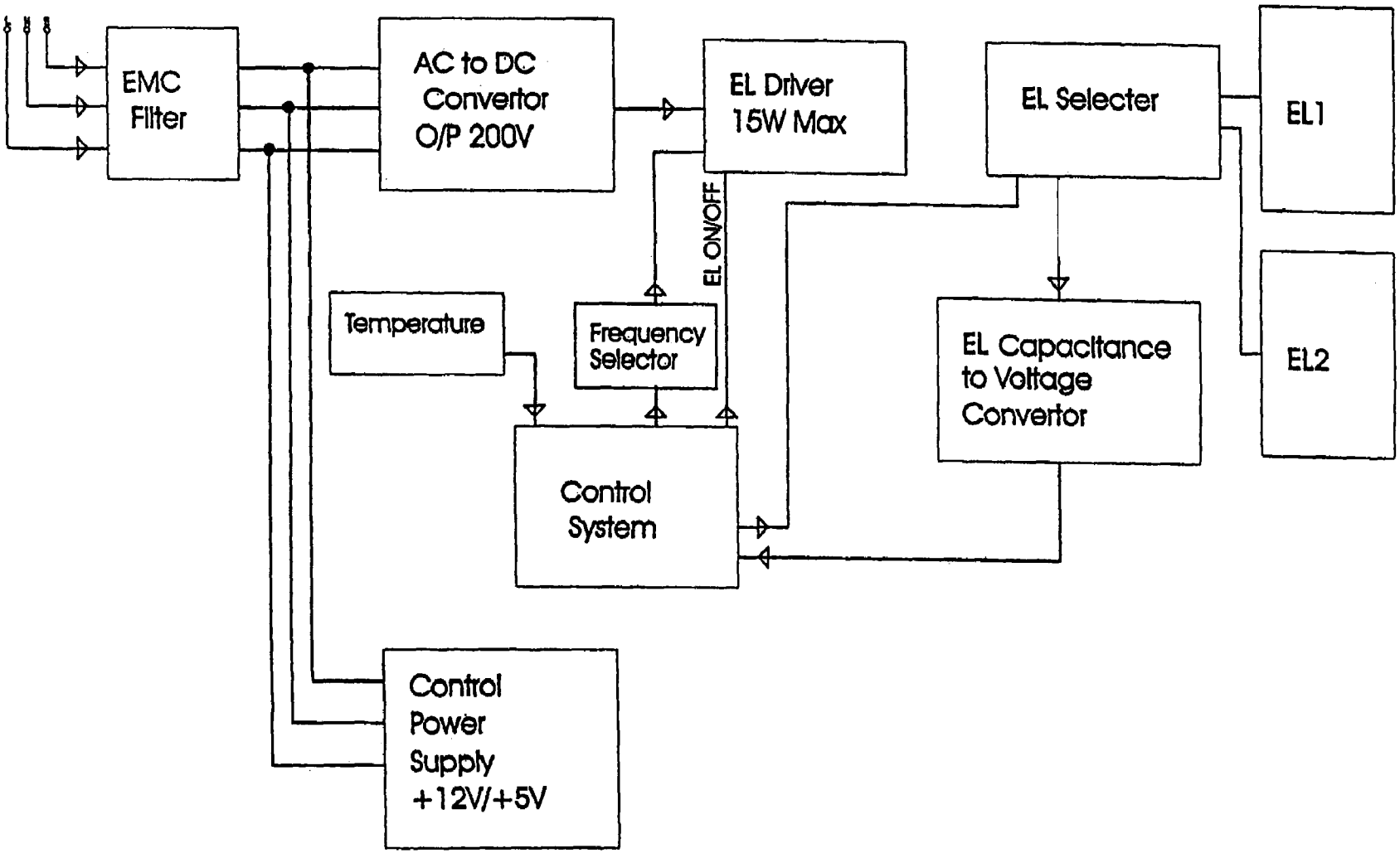
FIG. 12 is a block diagram showing the control electronics of another embodiment of a sign in accordance with the present invention.

FIGS. 10, 11 and 12 are block diagrams representing suitable circuits for controlling the EL elements in order to compensate for the temperature and degradation effects described above. Each block diagram includes the following components:

- EMC filter, which ensures compliance with regulations governing electromagnetic emissions;
- Power supply controller, which regulates the supply to the circuitry from the mains;
- AC to DC converter, which converts the alternating current from the mains (via the power supply controller) into the direct current required by the EL driver;
- EL driver, which generates the inputs required to drive the EL elements. The driver can allow for any size of sign up to one that draws a maximum of 15 Watts (the 900 mm round sign is the largest expected to be produced using the new technique, this is expected to draw around 15 Watts);
- EL selector, which decides (based on decisions made by the microprocessor) which EL element will be illuminated and which will be used as the capacitance switch;
- Capacitance to voltage converter, which converts the capacitance of the selected EL element into a voltage signal for the microprocessor, allowing it to determine between daytime and night-time.

Control system, which contains a microprocessor that makes decisions about the inputs for each of the EL elements.

In addition, the block diagrams include various units to account for the electrical and environmental degradation, and the effects of temperature.

Each element draws only the amount of power required to drive the EL panel at the specified brightness. This makes the sign very efficient and the electronics universally applicable over the full range of sign sizes and shapes.

The block diagrams shown below are based on an sign with two EL elements. More than two elements might also be used.

FIG. 10 is a block diagram showing the control electronics for one embodiment of the sign. This circuit is designed on the basis that a constant power model will compensate for both electronic degradation and temperature variations. The correction to the inputs of the EL elements are made by adjusting the frequency.

FIG. 11 is a block diagram showing the control electronics for an alternative embodiment of the sign. This circuit is designed on the basis that a constant power model will compensate for electrical degradation. An additional thermal resistor is used to compensate for the variations due to temperature.

FIG. 12 is a block diagram showing the control electronics for a yet further embodiment of the sign. The circuit uses a pseudo-constant power model to compensate for both electrical degradation and temperature variations. The correction to the inputs of the elements are made by adjusting the frequency in discrete steps.

Illuminated road signs are regularly checked at night to ensure correct functioning. On prior art, lamp-lit signs, the lamps are typically changed every 8,000 hours, and general maintenance is required every 2 years.

A sign in accordance with the invention should be very robust with no failure expected during the lifetime of the sign (10 years). However, the control circuitry is designed to monitor the system for any failure that might occur.

The micro-controller monitors the sign for any process that does not change within pre-programmed limits over e.g. a 5-day period. In other words, the elements should switch between "photodetector" and "photo-emitter" modes each day, and if this does not happen for five days then it is assumed that a fault is present.

If such a condition is detected the sign is switched to "OFF" until the problem is corrected. This ensures that a failure will always recognized at the next regular check-up or by road users who can then report the problem.

Figure 13:
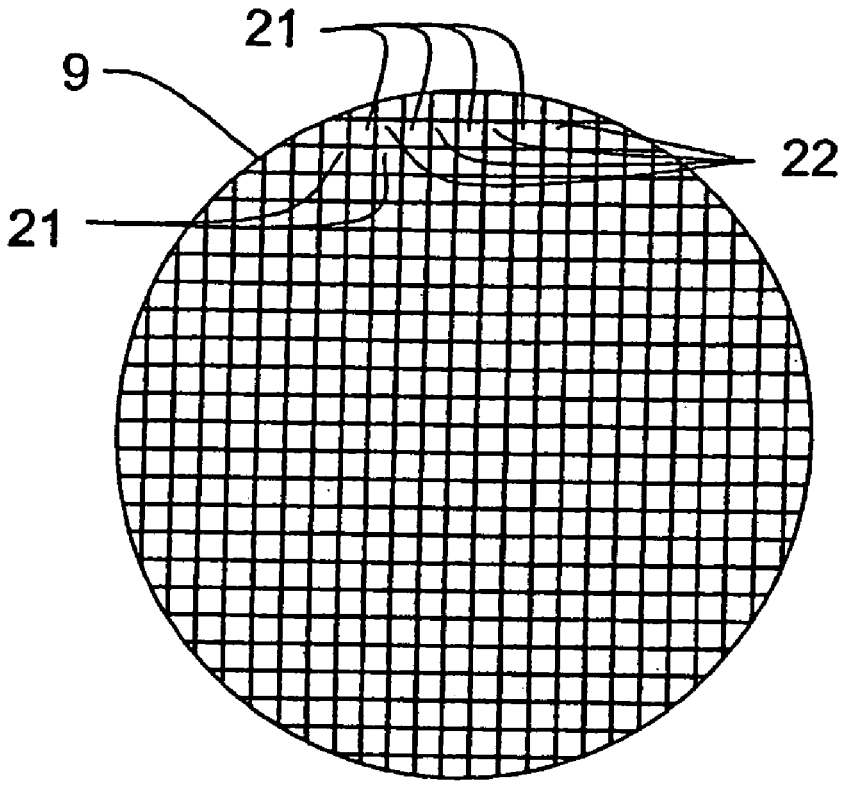
FIG. 13 shows a schematic view of light source arrays in accordance with an aspect of the present invention.

An alternative method which can be used to prolong the life of the ELF is to separate the ELF into discrete elements, or pixels, as shown schematically in FIG. 13. The ELF 9 is split up into interleaved arrays of elements 21, 22. Each array can be activated independently of the other array. Initially the elements 21 in the first array are activated. Because the array still covers the whole area of the sign panel 5, the sign still appears to be lit up, and its visibility is increased.

Eventually the illumination provided by the elements of the first array will have fallen below an acceptable level. Once this has occurred, the first array of elements 21 is no longer used, and the second array of elements 22 is used in its place. Thus the lifetime of the sign is doubled.

Alternatively, the second array of elements 22 could be kept as an emergency backup in case of failure of the primary circuit.

As another alternative, the first array of elements 21 could be illuminated one night, and the second array of elements 22 the following night, alternating in sequence and again doubling the life of the sign. Alternatively, each time the sign is to be illuminated the array to be activated could be chosen randomly.

It will be understood that although the system has been described with reference to two arrays of elements, three or more could equally be used.

In general, electroluminescent films are driven by current driven at 100V and 400 Hz. When power is supplied by mains electricity (240V and 50 Hz), a transformer and oscillator are used to provide the required waveform. The larger the area of the ELF, the larger the transformer required to drive it. Transformers cause power loss through the generation of heat and are relatively expensive components. It is therefore desirable to drive the ELF from the mains without the use of a transformer.

By using a high voltage oscillator at 200 Volts in conjunction with a circuit to reduce the mains voltage (240 Volts), the ELF can be used without the need for a transformer. At the higher voltage, the frequency required to achieve a particular brightness is typically reduced to ~200-250 Hz. This offsets the reduction in material life expectancy resulting from the increase in voltage. However, the area of panel that can be driven using this technique is limited (typically to around 640 $cm^2$).

A sign of 60 cm diameter has a total area of ~2800 $cm^2$. If the sign is divided into elements as described above, and half the elements are illuminated at any one time then the circuit is required to drive ~1400 $cm^2$ of ELF. In order to avoid the use of transformers, three high voltage inverter circuits running at 210 V will be required for this area. This requires that each half of the total area is further divided into three sets of evenly distributed elements (making six sets in total).

It will be appreciated that departures from the above described embodiments will still fall within the scope of the invention.

What is claimed is:

1. An illumined sign, comprising:

a sign panel;

at least two elements of electroluminescent material, each element being arranged so that it can emit light so as to illuminate the sign panel, each element being selectively actuatable independently of the or each other element, wherein each element is usable as a photo-emitter for emitting light so as to illuminate the sign panel and as a photodetector for measuring the amount of external light falling on the sign; and a control system for regulating power supplied to the elements when they act as photo-emitters, wherein the control system is arranged to regulate power supplied to the elements in such a way that brightness of the light emitted by an element remains substantially constant.

2. An illuminated sign as claimed in claim 1, wherein each element is arranged so that it can be operated:

as a photodetector by the measurement of the capacitance of that element from the application of a constant voltage to the element;

or as a photo-emitter by the application of an alternating voltage to that element.

3. An illuminated sign as claimed in claim 2, arranged so that when one element acts as a photo-emitter by emitting light, the other element acts as a photodetector for measuring the amount of external light falling on the sign.

4. An illuminated sign as claimed in claim 3, wherein the elements act alternately as photo-emitters and photodetectors.

5. An illuminated sign as claimed in claim 2, arranged so that none of the elements emits light if the external light falling on the sign is above a predetermined level.

6. An illuminated sign as claimed in claim 5, wherein the predetermined level is defined such that none of the elements emits light during the day.

7. An illuminated sign as claimed in claim 2, wherein the elements are arranged behind the sign panel so as to emit light therethrough.

8. An illuminated sign as claimed in claim 2, wherein each element comprises segments interlocking with corresponding segments in the or each other element so that the segments form a spatially alternating array.

9. An illuminated sign as claimed in claim 2, further comprising a control system for regulating power supplied to the elements when they act as photo-emitters.

10. An illuminated sign as claimed in claim 1, wherein the control system includes power measurement means for measuring the power drawn by each element, and wherein the power supplied to each element is determined on the basis of the power drawn by that element so as to correct for changes in temperature.

11. An illuminated sign as claimed in claim 1, further comprising a temperature measurement means for measuring the ambient temperature at the sign, the power supplied to the elements being regulated on the basis of the ambient temperature.

12. An illuminated sign as claimed in claim 1, wherein the power supplied to the elements is regulated so that the brightness of light emitted by the elements remains substantially constant for the lifetime of the sign.

13. An illuminated sign as claimed in claim 2, wherein each element comprises a film of electroluminescent material.

14. An illuminated sign as claimed in claim 1, further comprising:

two arrays of light sources arranged to illuminate said sign panel, each array being selectively activatable independently of the or each other array, the light sources of each array being spatially alternated across the width of the panel.

15. An illuminated sign as claimed in claim 14, wherein one array is arranged to be activated if the other array fails.

16. An illuminated sign as claimed in claim 14, wherein one array is arranged to be activated after the end of the useful life of the other array.

17. An illuminated sign as claimed in claim 14, arranged so that the arrays are only activatable when external light falling on the sign falls below a predefined level, so that the sign is not illuminated during the day.

18. An illuminated sign as claimed in claim 14, arranged so that the arrays are selectively activated in sequence.

19. An illuminated sign as claimed in claim 14, arranged so that the arrays are selectively activated in a random sequence.

20. An illuminated sign as claimed in claim 14, comprising more than two arrays of light sources.

21. An illuminated sign as claimed in claim 14, wherein the light sources comprise an electroluminescent material.

22. An illuminated sign as claimed in claim 21, wherein the electroluminescent material is used to detect the level of external light falling on the sign.

23. An illuminated sign as claimed in claim 14, further comprising a retro-reflective portion.

24. An illuminated sign as claimed in claim 23, wherein the retro-reflective portion is arranged behind the sign panel.

25. An illuminated sign as claimed in claim 14, further comprising detection apparatus for detecting the approach of a vehicle, the sign being arranged so that the light source is activated only if a vehicle is approaching.

26. An illuminated sign assembly, comprising an illuminated sign as claimed in claim 14 and a power source.

27. The illuminated sign assembly of claim 26, wherein the power source is a rechargeable battery.

28. The illuminated sign assembly of claim 27, further comprising recharging means for recharging the rechargeable battery.

29. The illuminated sign assembly of claim 28, wherein the recharging means comprises a photovoltaic cell.

30. An illuminated sign, comprising:

a sign panel;

at least two elements of electroluminescent material, each element being arranged so that it can emit light so as to illuminate the sign panel, each element being selectively actuatable independently of the or each other element, wherein each element is usable as a photo-emitter for emitting light so as to illuminate the sign panel and as a photodetector for measuring the amount of external light falling on the sign; and a control system for regulating power supplied to the elements when they act as photo-emitters, wherein the control system is arranged to determine whether or not each element switches between use as a photodetector and a photo-emitter on a regular basis, and if not to set all the elements so that they do not act as photo-emitters.

31. A method of illuminating a road sign comprising a sign panel and first and second electroluminescent light sources, the method comprising:

measuring the capacitance of the first light source;

determining the level of external light falling on the sign from the measured capacitance; and illuminating the sign panel with the second light source if the external light falls below a predefined level.

32. A method as claimed in claim 31, further comprising, after the external light has fallen below the predefined level:

measuring the capacitance of the first light source and determining the level of external light falling on the sign from the measured capacitance;

if the external light rises above the predefined level, ceasing illumination of the sign panel with the second light source.

33. A method as claimed in claim 32, further comprising, after ceasing illumination of the sign panel with the second light source:

measuring the capacitance of the second light source so as to determine the level of external light falling on the sign;

illuminating the sign panel with the first light source if the external light falls below a predefined level.

34. A method as claimed in claim 31, wherein the predefined level is defined such that neither light source emits light during the day.

* * * * *